United States Patent [19]

Atsumi et al.

[11] Patent Number: 4,778,955

[45] Date of Patent: Oct. 18, 1988

[54] LIMIT SWITCH ASSEMBLY

[75] Inventors: Haruo Atsumi, Otsu; Yasuhiro Kiyono, Kyoto, both of Japan

[73] Assignee: Omron Tateiei Electronics Co., Kyoto, Japan

[21] Appl. No.: 6,294

[22] Filed: Jan. 20, 1987

Related U.S. Application Data

[63] Continuation of Ser. No. 776,102, Sep. 16, 1985, abandoned, which is a continuation of Ser. No. 659,018, Oct. 9, 1984, abandoned, which is a continuation of Ser. No. 363,526, Mar. 30, 1982, abandoned.

[30] Foreign Application Priority Data

Mar. 30, 1981 [JP] Japan ..... 56-48185

[51] Int. Cl.[4] ..... H01H 3/16; H01H 21/28

[52] U.S. Cl. ..... 200/47; 200/153 V; 200/153 T; 200/153 LB; 200/327

[58] Field of Search ..... 200/47, 153 V, 324, 200/325, 153 LB, 68.1, 327, 153 T; 74/97, 100 R, 527, 107

[56] References Cited

U.S. PATENT DOCUMENTS

| | | | |
|---|---|---|---|
| 1,423,624 | 7/1922 | Rice | 200/47 |
| 1,966,115 | 7/1934 | Da Costa | 200/68.2 |
| 2,059,712 | 11/1936 | Schellenger | 200/68.1 |
| 2,957,536 | 10/1960 | Ulinski | 200/153 T |
| 3,120,589 | 2/1964 | Westberg | 200/153 LB |
| 3,155,936 | 1/1965 | Daugherty | 74/527 |
| 3,244,015 | 4/1966 | Parris, Jr. | 200/47 X |
| 3,317,687 | 5/1967 | Dehn | 200/47 |
| 3,467,800 | 9/1969 | Barr | 200/153 V |
| 3,740,504 | 6/1973 | Hipple | 200/47 |
| 3,749,860 | 7/1973 | Crepeau | 200/47 |
| 3,829,637 | 8/1974 | Kilcoin | 200/47 |
| 3,931,484 | 1/1976 | Chace et al. | 200/47 |
| 3,959,614 | 5/1976 | Graninger | 200/47 |
| 4,242,548 | 12/1980 | Atsumi | 200/47 |
| 4,381,437 | 4/1983 | Geremia | 200/153 LB |
| 4,398,618 | 8/1983 | Hansen | 200/153 T X |

FOREIGN PATENT DOCUMENTS

| | | | |
|---|---|---|---|
| 1123021 | 2/1962 | Fed. Rep. of Germany | 200/47 |
| 366084 | 1/1963 | Switzerland | 200/47 |
| 906990 | 9/1962 | United Kingdom | 200/153 LB |

OTHER PUBLICATIONS

Translation of Swiss Patent 366084.

*Primary Examiner*—Henry J. Recla
*Assistant Examiner*—Ernest G. Cusick
*Attorney, Agent, or Firm*—Cushman, Darby & Cushman

[57] ABSTRACT

A switch assembly comprising an actuator plunger for actuating a built-in switch, a rotary shaft for rotating in response to an external operating force, and a cam coupled to the rotary shaft and adapted to contact the actuator plunger, the actuator plunger being adapted to be moved upwardly or downwardly in response to a rotation of the rotary shaft through the cam so as to switch the built-in switch, and the cam having a hole to provide a predetermined free angular play between the rotary shaft and the cam as assembled.

20 Claims, 6 Drawing Sheets

LIMIT SWITCH ASSEMBLY

This application is a continuation of application Ser. No. 776,102 filed Sept. 16, 1985, which was a continuation of application Ser. No. 659,018 filed, Oct. 9, 1984, which was a continuation of application Ser. No. 363,526, filed Mar. 30, 1982, all of which are abandoned.

BRIEF SUMMARY OF THE INVENTION

This invention relates to a limit switch assembly generally used as a position detector in a machine or the like, and more particularly to a limit switch assembly of a hold-type which keeps its operating position after relief of an external operating force applied to the assembly.

There has long been known a limit switch assembly, for instance, as illustrated in FIGS. 1 to 3, which includes a housing body 1 housing a built-in switch 2 therein, an operating head member 3 fixed on a head portion of the housing body 1, a rotary shaft 5 supported in the operating head member 3, and an L-shaped roller lever 4, which is a means adapting for sensing movement of an external object fixed to a pointed end portion of the rotary shaft 5. In an upper position of the housing body 1, there is disposed an actuator plunger 6 for actuating a push button 2*a* of the built-in switch 2 for upward and downward movement. A cam 7 abutted by the plunger 6 is fixed to the rotary shaft 5. An upper surface of the cam 7 is pushed by a roller 10 supported by a movable plunger 9 biassed downwardly by a spring 8 in such a manner that when the roller lever 4 is rotated either clockwise or counterclockwise to a certain extent, the cam 7 is adapted to be held in the position. A lower surface of the cam 7 is always pushed by the plunger 6 biassed by a spring 6a so as to be followed by the plunger 6.

The above-mentioned limit switch is operated in such a manner that when the roller lever 4 of FIG. 1 is rotated about its own axis through an angle of 90° in a clockwise direction, the rotary shaft 5 is rotated together with the cam 7 so as to depress the plunger 6 downwardly and turn on the switch 2, and then, when the roller lever 4 is rotated about its own axis through an angle of 90° in a reverse direction to its original position, the plunger 6 moves in an upward direction to its original position following the cam 7 so as to turn off the switch 2.

When the roller lever 4 is rotated in a clockwise direction, viz., in a setting operation, as illustrated in FIG. 4A, the built-in switch 2 is turned on in a position which is a little over the position (hereinafter described as "mechanical center") where the roller 10 of the plunger 9 contacts a top portion 7*a* of the cam 7. Meanwhile, in a resetting operation as illustrated in FIG. 4B, the switch 2 is adapted to be turned off in a position which is a little over the mechanical center. Thus, the respective ON and OFF switching positions of the built-in switch 2 are close to the mechanical center. Therefore, as the position of the cam 7 is approaching to themechanical center, a contact pressure applied in the switch 2 is decreased. Moreover, the respective ON and OFF switching positions are liable to get out of order due to the abrasion or dimensional error developed in the contacts by switching load. Thus, the conventional limit switch assembly has the disadvantage that since the respective ON and OFF switching positions are close to the mechanical center, the exact operation of the assembly is not ensured and undesirable contact chattering is liable to be developed.

In order to avoid this disadvantage, there may be proposed to provide a limit switch assembly such that the above-mentioned cam 7 is partially removed therefrom as illustrated in dotted lines of FIG. 5A so that the built-in switch 2 is turned on when the cam 7 is rotated completely over the mechanical center. The proposed assembly, however, has the disadvantage that when the cam 7 is rotated in a counterclockwise direction as illustrated in FIG. 5B, the switch 2 is turned off upstreams of the position of the mechanical center. This advantage is fatal in view of the characteristics required in the limit switch assembly in practical use.

This invention, therefore, has been developed with a view to eliminating the above-described disadvantages, and has its essential object to provide an improved limit switch assembly wherein a built-in switch is ensured to be switched after a cam is rotated completely over a mechanical center so as to overcome any drop in a contact pressure and the contact chattering for a precise switching operation.

Other objects as well as the numerous advantages of the limit switch assembly according to this invention will become apparent from the following detailed description and the acompanying drawings, in which:

DESCRIPTION OF THE PREFERRED EMBODIMENT

Figure 1:
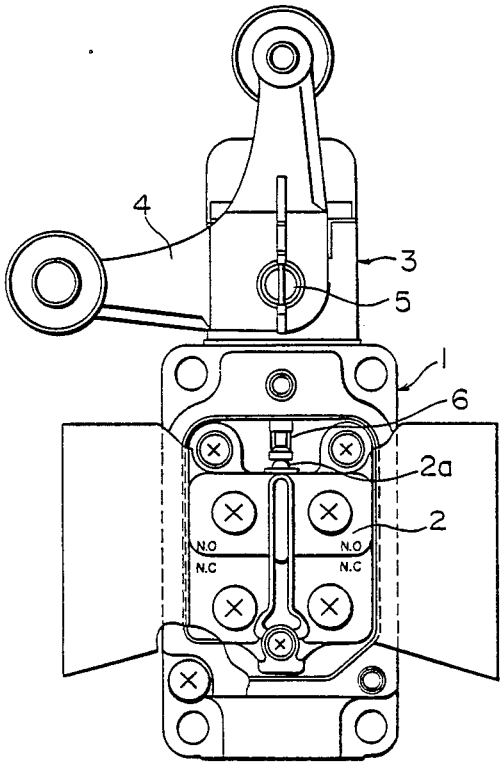
FIG. 1 (PRIOR ART)
FIG. 1 is an elevational view of a conventional limit switch assembly.
Figure 2:
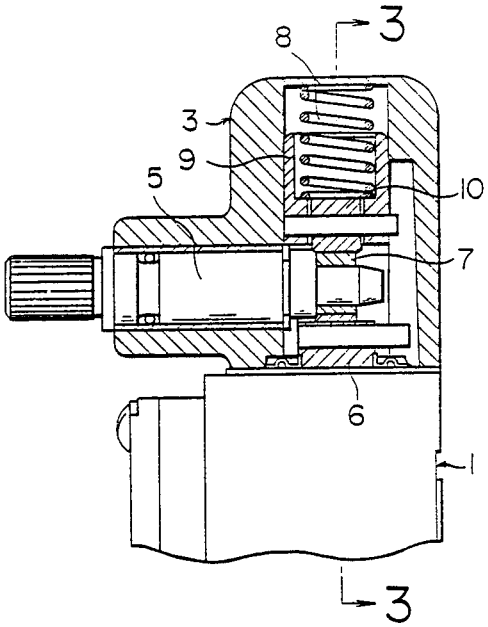
FIG. 2 (PRIOR ART)
FIG. 2 is right-side partial section view of the assembly of FIG. 1.
Figure 6:
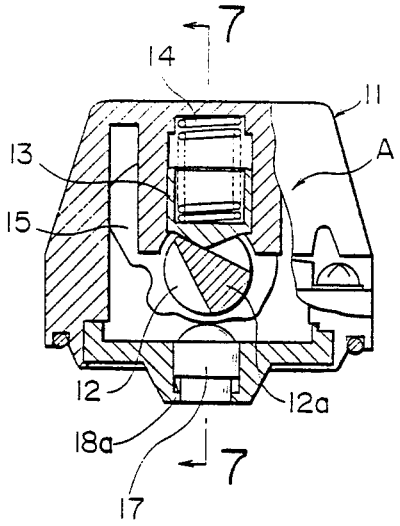
FIG. 6 is a side partial section view of an operating head member employed in a limit switch assembly as a preferred embodiment of this invention.
Figure 7:
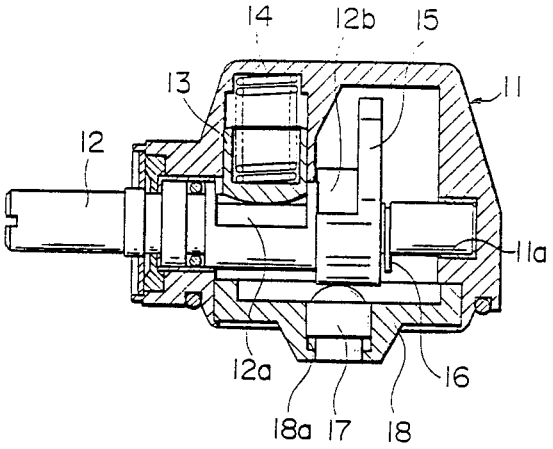
FIG. 7 is a sectional view taken along the line 7—7 of the assembly of FIG. 6.
Figure 8:
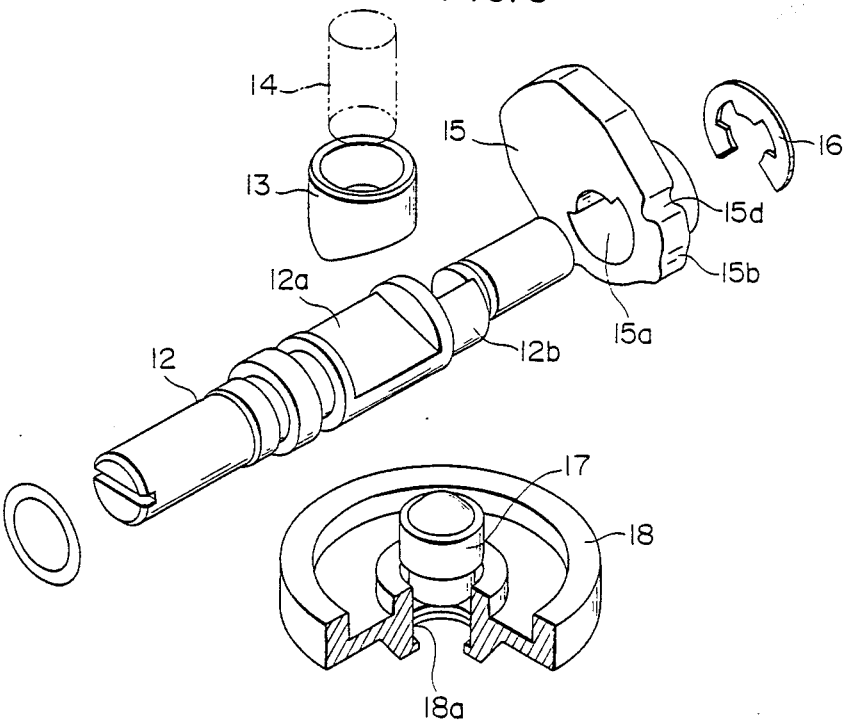
FIG. 8 is a perspective disassembled view showing an inner mechanism of the head member of FIG. 6.

Referring, now, to FIGS. 6 through 8, there is shown an operating head member or head housing 11 employed in a limit switch assembly and an inner mechanism of the head member in accordance with this invention. Within the head member 11 there is rotatably disposed a rotary shaft 12 to one end of which a lever (not shown, such as the lever 4 of FIG. 1) is fixed in a construction similar to that of a conventional operating head member. The reference numerals 13 and 14 represent a movable plunger and a spring, respectively. The movable plunger 13 at a slope thereof pushes a slope of a triangular portion 12*a* formed in the rotary shaft 12 so as to bias the shaft 12 toward one direction or the other. Thus, a turning over mechanism A is constructed.

Figure 9:
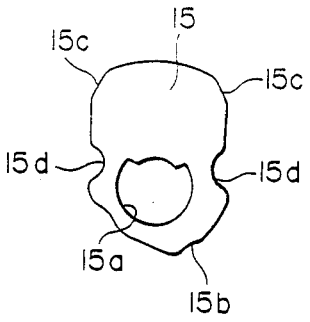
FIG. 9 is a front view of a cam employed in the head of FIG. 8.
Figure 10:
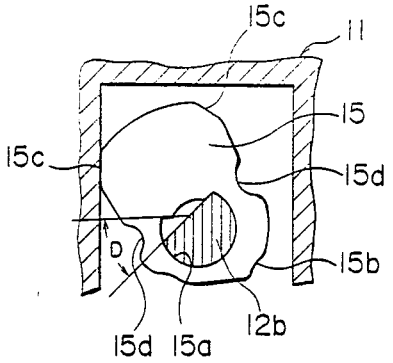
FIG. 10 is a sectional view of the cam which is interposed in the head member.

A cam 15 is engaged with a shaft portion 12*b* having a generally crescent or half-moon-shaped section formed in the rotary shaft 12, and is prevented by an E-shaped ring 16 from being slipped out of the portion 12*b*. As illustrated in FIGS. 9 and 10, a hole 15*a* of the cam 15 is engaged with the shaft portion 12*b* providing a predetermined free angular play or dummy angle D in such a manner that the cam 15 is freely rotatably with respect to the shaft 12 within the angular play D. A groove portion 15*b* 1 or nub means is formed in a bottom end of the cam 15 in an operating limit position, so that when the cam 15 is rotated to the operating limit position, a head portion of an actuator plunger 17 is engaged with the groove portion 15*b*. A straight-cut surface 15*c* is formed in each upper side of the cam 15 to come into contact with an inner surface of the head housing 11, whereby a rotatable angle of the rotary shaft 12 is restricted. A recessed portion 15*d* is formed in each central side of the cam 15 so that both central sides thereof are sandwitched by a forked tool (not shown).

Figure 3:
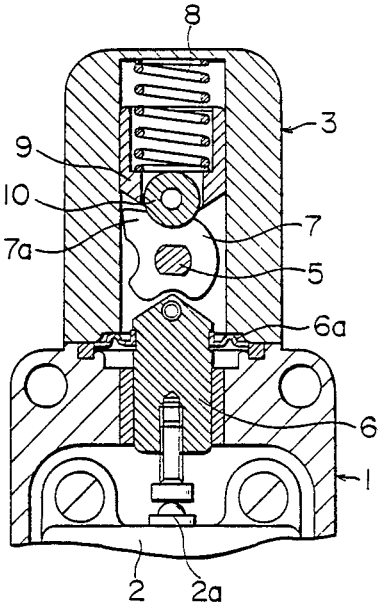
FIG. 3 (PRIOR ART)
FIG. 3 is a sectional view taken along the line 3—3 of the device of FIG. 2.
Figure 4A:
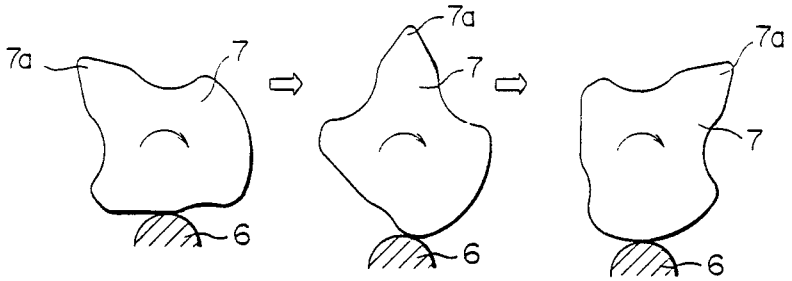
FIG. 4A (PRIOR ART)
FIGS. 4A and 4B are views illustrating a setting and a resetting operation principle of a cam, respectively.
Figure 4B:
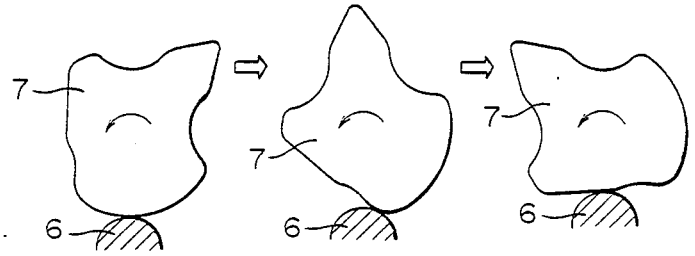
FIG. 4B (PRIOR ART)
Figure 5A:
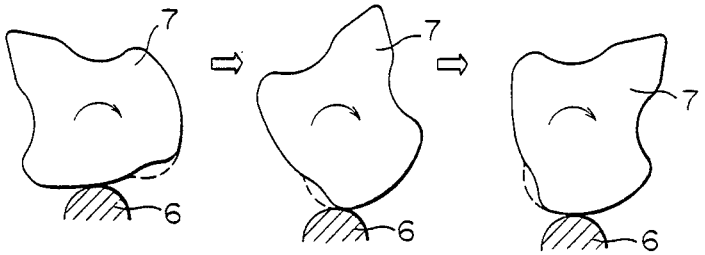
FIG. 5A (PRIOR ART)
FIGS. 5A and 5B are views illustrating a setting and a resetting operation principle of an improved cam, respectively.
Figure 5B:
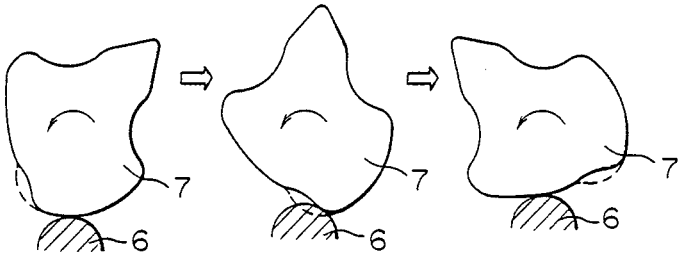
FIG. 5B (PRIOR ART)

To a bottom opening portion of the operating head 11 is fixed a cover member 18 having a central hole 18*a* through which the actuator plunger 17 is adapted to be slidably inserted for upper and lower movements so as to actuate a push button of a built-in switch (not shown). The actuator plunger 17 is disposed to be biassed upward by a resetting force from said push botton of the built-in switch (not shown) so as to contact the cam 15, but may be biassed upward by a resetting spring as illustrated in FIG. 3 about spring 6*a*.

The above-mentioned head 11 is assembled as follows:

The movable plunger 13 carrying the spring 14 is installed in the head housing 11 from downwards. While the plunger 13 is pushed up by a certain tool, the rotary shaft 12 is inserted into the head housing 11 from sidewards. Then, the cam 15 catched by a certain tool is inserted into the head 11 from downwards so that the through hole 15*a* of the cam 15 is pierced by one end of the rotary shaft 12. Moreover, the pointed end of the rotary shaft 12 is engaged with a shaft receiving portion 11*a* of the head housing 11, whereby the triangular portion 12*a* of the rotary shaft 12 is pushed by the movable plunger 13 and the half-moon shaped shaft portion 12*b* of the rotary shaft 12 is coupled with the hole 15*a* of the cam 15. Thereafter, the E-shaped ring 16 is mounted on the shaft 12 so as to prevent the cam 15 from being slip off. Finally, the cover member 18 is fixed to the lower opening portion of the head housing 11, and the whole assemblage of the head member 11 is completed.

In order to insert the cam 15 into the head housing 11, the hole 15*a* of the cam 15 and the shaft portion 12*b* of the rotary shaft 12 must be arranged in predetermined directions so as to be engaged with each other, and the degree of the insertion of the cam 15 must be adjusted so that an axis of the shaft 12 is aligned with a center of the hole 15*a* of the cam 15. Especially, due to the miniaturization of the head member 11, the space of its lower hole is small, so that working for inserting the cam 15 is very difficult to be manually performed. Therefore, a pair of recessed portions 15*d* are formed in the cam 15 so as to be held by a pincette-shaped machine tool, and such insertion work is able to be automatically performed by an automatic machine.

Figure 11:
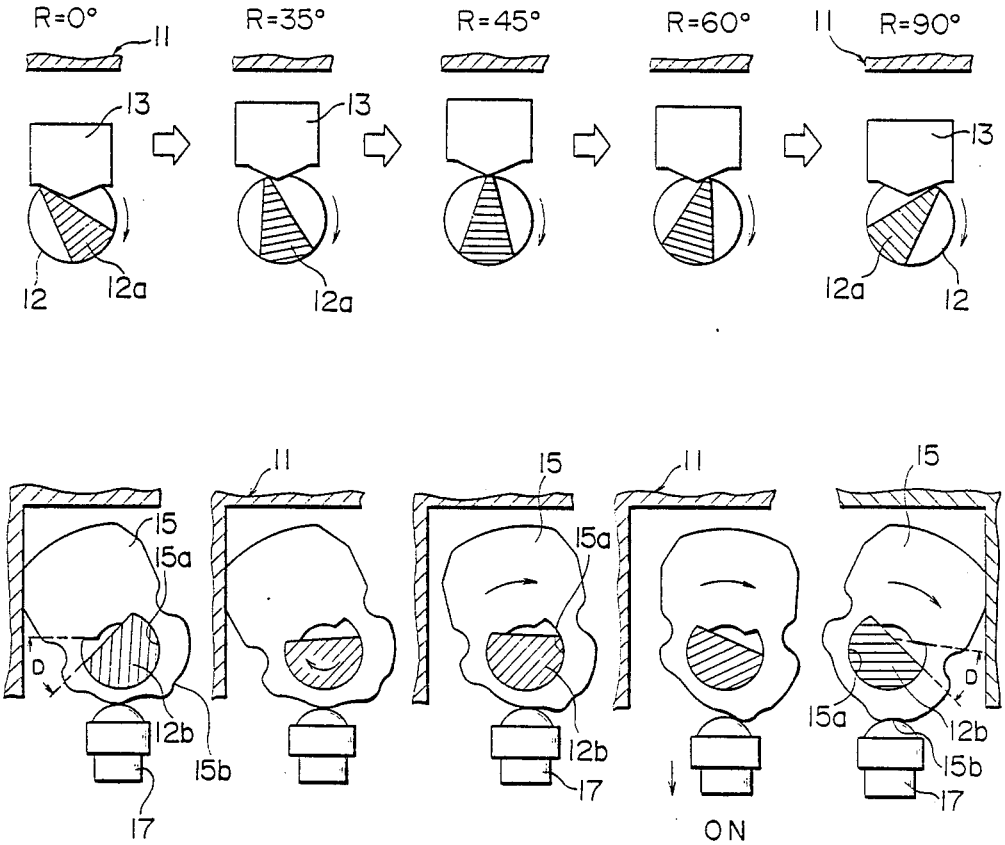
FIGS. 11 and 12 are views illustrating principles of a setting operation and a resetting operation.
Figure 12:
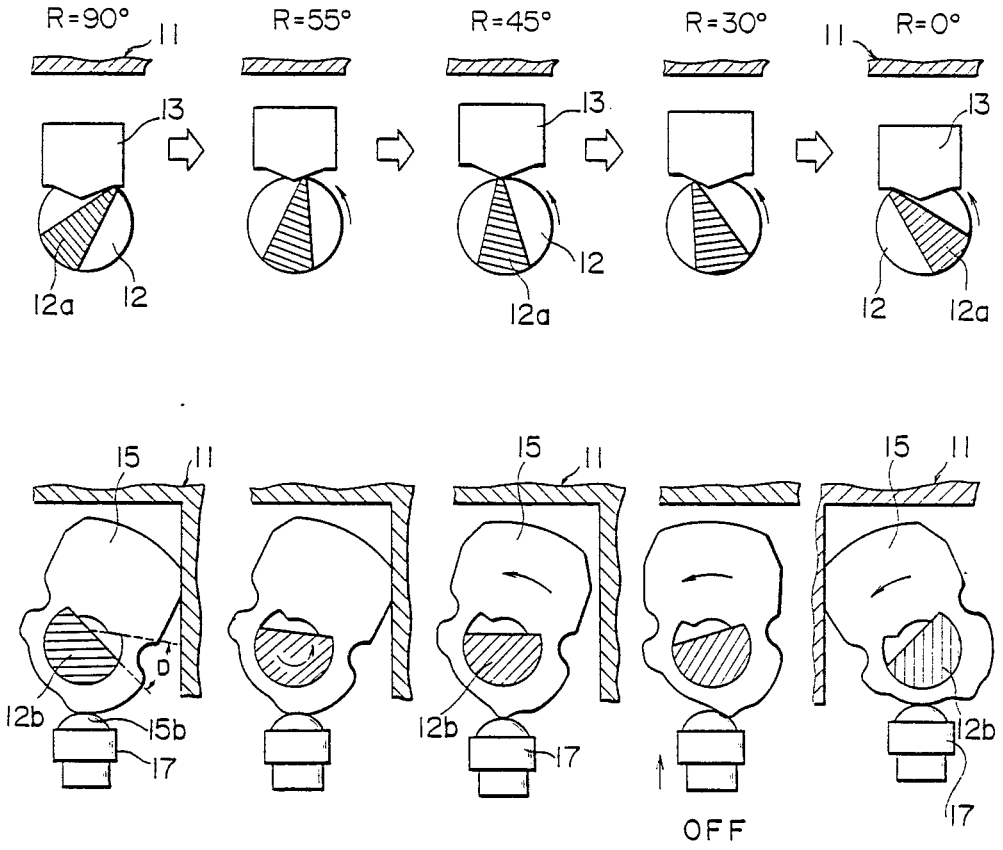

Returning to FIGS. 11 and 12, the operations of the limit switch assembly according to this invention are described hereinafter.

In an initial position where a lever (not shown) fixed to the pointed end of the rotary shaft is not actuated yet (lever angle R=O°), the rotary shaft 12 is biased in a counterclockwise direction by the movable plunger 13 wherein the actuator plunger 17 is not depressed yet. As the rotary shaft 12 is rotated clockwise by moving the lever, the triangular portion 12*a* lifts up the plunger 13 but the cam 15 is not yet rotated because of a provision of the free angular play (D=35°) between cam 15 and shaft portion 12*b*. As the lever angle R goes beyond 35°, the cam 15 is rotated in cooperation with the roatary shaft 12 and the actuator plunger 17 is gradually depressed. When the lever angle R becomes 45°, the switch assembly reaches a mechanical center, wherein a top end of the triangular portion 12*a* of the rotary shaft 12 is in the highest position in cooperation with the movable plunger 13. If the shaft 12 is further rotated, it quickly rotates by the plunger 13 downwardly biassed by spring 14 until the lever angle R becomes 90°. When the lever angle R further reaches 60°, the built-in switch is turned on by the plunger 17 depressed by the cam 15. When the lever angle R becomes 90°, the head portion of the plunger 17 is engaged with the recessed portion 15*b* beyond a projecting portion of the cam 15, wherein the lever, the rotary shaft 12 and the cam 15 keep their positions.

As the lever is rotated in a reverse direction, the rotary shaft 12 is rotated together therewith but the cam 15 is not rotated until the lever angle R returns 55°. Further, when the lever angle R returns to 30° beyond the mechanical center (the lever angle R=45°), the built-in switch is turned off, and, thereafter, the rotary shaft 12 quickly returns to its original position where the lever angle R is 0°, thanks to a biassing force by the movable plunger 13.

Thus, in the above-described setting operations (see FIG. 11) the cam 15 is rotated just within 45°−35°=10° up to the mechanical center (lever angle R=45°), where the actuator plunger 17 is little depressed, because of the free angular Play (D=35°) between rotary shaft 12 and cam 15. Therefore, it does not happen that the contact pressure of the built-in switch is descreased as the mechanical center is approached. The built-in switch is switched in the position (lever angle R=60°) sufficiently beyond the mechanical center, so that the switching position is shifted from the mechanical center through 60°−45°=15°. Therefore, even if contacts are worn out or a scale error exists, the limit switch assembly is free from unstable operations and contact chatterings. Thus, it can be seen that the switch exhibits a hysteresis in its operation. In the resetting operations (see FIG. 12), the cam 15 is rotated through 10° to reach the mechanical center, and only where it is sufficiently beyond the mechanical center, the built-in switch is actuated.

In order to avoid the disadvantage that the cam 15 in the above-described resetting operations is rotated together with the rotary shaft 12 by a friction force developed between the shaft portion 12*b* and the hole 15*a* and the built-in switch is turned OFF upstreams of the mechanical center, the groove portion 15*b* is formed on a contact surface of the cam 15 in the operating limit position so as to be engaged with the head portion of the actuator plunger 17 and stop the movement of the cam 15 by such a friction force.

Figure 13:
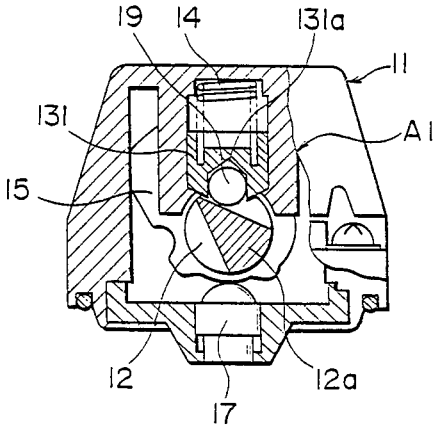
FIG. 13 is a side partial section view of an operating head member as a modification of the head member of FIG. 6.

Returning to FIG. 13, there is shown a modified operating head member 11 of the embodiment of FIG. 6. The operating head member 11 has a turning over mechanism A1 wherein a steel ball 19 is rotatably installed into a recessed portion 131*a* formed in one end of a movable plunger 131 and is adapted by a biassing forced of spring 14 to push a slope of triangular portion 12*a* of rotary shaft 12. Other components are the same as those of the assembly of FIG. 6. According to this modified embodiment of this invention, the movable plunger (131) goes over a top end of the triangular portion (12*a*) of the rotary shaft (12) through the steel ball (19) in its mechanical center. Therefore, a free rotation of the steel ball decreases the waste of said top end of the triangular portion, whereby the position of the mechanical center is not shifted in even long time period. Thanks to the steel ball (19), the rotary shaft (12) smoothly turns over prividing a quick tutrning operation.

From the foregoing description of this invention, it has now become clear that by having a free angular play between a rotary shaft and a cam, the switching position of a built-in switch is sufficiently delayed after the mechanical center is reached, and any decrease of contact pressure or the chattering of contacts is overcome, thus ensuring stable operation characteristics.

It should be understood that the above description is merely illustrative of this invention and that many charges and modifications may be made by those skilled in the art without departing from the scope of the appended claims.

What is claimed is:

1. A switch actuator which operates in response to the movement of an external device comprising:

a rotary shaft adapted to be rigidly coupled to said external device and having a mating portion of a noncircular outer circumference;

a cam having interior surfaces defining a bore for receiving said mating portion with a predetermined amount of free play between said interior surfaces and said mating portion so that said shaft rotates in either direction independently of said cam for the amount of said free play, said cam then rotating with said shaft in said either direction, thereby moving said cam in a direction only after said shaft has rotated in said either direction in the amount of said free play;

a wedge, coupled to said shaft, having a first bias receiving surface and a second bias receiving surface, said first and second bias receiving surfaces each being substantially flat surfaces which meet at an angle which defines a bias surface selection area;

a single spring structure;

a plunger, coupled to said spring structure, for biasing against said first bias receiving surface when said shaft is at a location which locates said plunger on one side of said bias surface selection area, and biasing against said second bias receiving surface when said shaft is at a location which locates said plunger on the other side of said bias surface selection area; and means for actuating a switch when the rotation of said cam reaches a predetermined point.

2. An actuator as in claim 1 further comprising means for limiting the rotation of said cam.

3. An actuator as in claim 2 wherein said limiting means includes a housing extending around said cam and said cam has an extending projection on its exterior surface so that said extending projection contacts said housing at a point in the rotation of said cam, thus terminating the rotation of said cam at said point.

4. An actuator as in claim 1 further comprising guide means for guiding said plunger and wherein said plunger comprises:

(a) force receiving surface means, connected so that said spring structure biases thereagainst;

(b) a plurality of side surfaces adapted for being guided by said guide means;

(c) force applying surface holding means, having two lowest surfaces that are inclined with respect to the horizontal, for holding a force applying surface;

(d) a substantially spherical force applying surface, held by said force applying surface holding means at a lowest location of said plunger, so that said force applying surface applies force to said first bias receiving surface when said rotary shaft positions said wedge on one side of said bias surface selection area and applies force to said second bias receiving surface when said rotary shaft positions said wedge on another side of said bias surface selection area.

5. An apparatus as in claim 4 wherein said two surfaces of said force applying surface holding means are inclined with respect to the horizontal by angles which are substantially equivalent, said angles being angles such that said plunger can bias against said wedge without said two surfaces contacting said wedge.

6. An actuator as in claim 1 wherein said rotary shaft has two non-rounded edges with a contact surface extending therebetween, and wherein said bore has at least two non-rounded edges adapted to contact said non-rounded edges and said contact surface of said rotary shaft, said rotary shaft and said bore contacting each other only at contact portions closest to said non-rounded edges, each contact portion being along a length of said contact surface which is less than half of said length.

7. An actuator as in claim 1 wherein said plunger comprises a cylinder adapted to be biased by said single spring structure, and a generally spherical ball, coupled to said plunger so that said ball applies the spring force to said wedge.

8. A switch assembly with hysteresis to prevent contact bounce, comprising:

a spring-biased switch with first and second positions;

rotary shaft means for rotating in response to an external force, and having a mating portion with a noncircular cross section;

a cam having interior surfaces defining a bore for receiving said mating portion, thus coupling said cam to said shaft means, said bore being larger in area than an area defined by said mating portion of said shaft means and including a first and a second shoulder means for mating with said mating portion so that when said shaft means is mated with said first shoulder. means, said cam rotates along with said rotary shaft in a counterclockwise direction, but said rotary shaft can rotate independently of said cam in a clockwise direction, and when said shaft is mated with said second shoulder means, said cam rotates along with said rotary shaft in a clockwise direction, but said rotary shaft can rotate independently of said cam in a counterclockwise direction, said first and second shoulder means being separated by a predetermined angle, thereby allowing lost motion between said shaft and said cam in the amount of said angle;

means for altering the position of said switch when said cam reaches a predetermined location in the rotation of said cam;

a wedge, rigidly coupled to said rotary shaft means, which has a first force transmitting surface, and a second force transmitting surface, which are each substantially flat and meet at an angle, a mechanical center area being defined between said first and second force transmitting surfaces;

spring bias means, including a spring and a single plunger coupled to said spring and located in a guide bore, for applying spring force to said wedge, said plunger. (a) biasing said first force transmitting surface of said wedge when said rotary shaft means is in a position which locates said plunger on one side of said mechanical center area, and (b) biasing said second force transmitting surface when rotary shaft means is in a position which locates said plunger on another side of said mechanical center area.

9. An assembly as in claim 8 further comprising means for limiting the rotation of said cam.

10. An assembly as in claim 9 wherein said limiting means includes a housing around said cam and said cam having an extending projection on its exterior surface so that said extending projection contacts said housing means at a point in the rotation of said cam, thus terminating the rotation of said cam at said point.

11. An assembly as in claim 8 further comprising guide means for guiding said plunger, and wherein said plunger comprises:

(a) force receiving surface means, connected so that said spring biases thereagainst;

(b) a plurality of side surfaces adapated for being guided by said guide means;

(c) force applying surface holding means, having two lowest surfaces that are inclined with respect to the horizontal, for holding a force applying surface;

(d) a substantially spherical force applying surface, held by said force applying surface holding means at a lowest location of said spring bias means, so that said force applying surface applies force to said first force transmitting surface when said rotary shaft positions said wedge on one side of said mechanical center area and applies force to said second force transmitting surface when said rotary shaft positions said wedge on another side of said mechanical center area.

12. An assembly as in claim 11 wherein said two surfaces of said force applying surface holding means are inclined with respect to the horizontal by angles which are substantially equivalent, said angles being angles such that said plunger can bias against said wedge without said two surfaces contacting said wedge.

13. An assembly as in claim 8 wherein said spring bias means includes said plunger, a generally spherical ball, and said spring in said plunger so that said ball applies the spring force to said surfaces of said wedge.

14. An assembly as in claim 8 wherein said bore of said cam has the cross section of a circle shape wherein an arc of the circle has been removed.

15. An assembly as in claim 8 wherein said first and second positions of said switch are on and off.

16. An assembly as in claim 8 further comprising means for assuring that said rotary shaft means will rotate independently of said cam when said mating portion is not engaged with one of said shoulder means.

17. A limit switch assembly with hysteresis to prevent contact bounce, comprising:

a spring-biased switch with a first and second position corresponding to on and off respectively;

means adapted for sensing movement of an external object;

a rotary shaft coupled to said sensing means, having at least one position with a cross-section of the shape of a circle with an area defined by an arc thereof removed, thereby leaving at least two non-rounded edges and a single contact surface extending between said non-rounded edges;

a cam having interior surfaces defining a bore larger in area than said portion of said shaft, said bore coupled to said shaft;

at least 180° of said bore being of generally circular shape of a substantially similar size as said circle formed by said portion of said shaft, the remaining degrees of said bore having two non-rounded edges situated to disallow free rotation of said one portion of said rotary shaft and adapted to contact said nonrounded edges of said rotary shaft along entire straight segments of the bore, and to contact only contact portions of said contact surface, said contact portions being areas closest to said non-rounded edges of said rotary shaft, and each contact portion being along a portion of said contact surface which is less than half of a length of said contact surface, so that when said shaft is mated with said first non-rounded edge, said cam moves along with said shaft in a counterclockwise direction, but said shaft moves independently of said cam in a clockwise direction, and when said shaft is mated with said second non-rounded edge, said cam moves along with said shaft in a clockwise direction, but said shaft moves independently of said cam in a counterclockwise direction; said edges being separated by a predetermined angle, thereby allowing rotation of said shaft independently of said cam in the amount of said angle;

nub means on the exterior of said cam for changing the position of said switch between said first and second positions when said nub means and said switch are located one over the other;

an extending projection rigidly coupled to said cam;

a housing surrounding said cam so that said extending projection contacts said housing, thereby limiting the rotation of said cam;

a wedge, rigidly coupled to said shaft and having first and second force transmitting surfaces each of which are substantially flat and meet at an acute angle at a force transmitting surface selection area;

a single spring force applying means including a single plunger assembly, a spring biasing said plunger assembly downward, and guide means for guiding said plunger assembly so that it can only move up and down said plunger assembly comprising:

(a) force receiving surface means, connected so that said spring biases thereagainst;

(b) a plurality of side surfaces adapted for being guided by said guide means;

(c) force applying surface holding means, having two lowest surfaces that are inclined with respect to the horizontal, for holding a force applying surface; and (d) a substantially spherical force applying surface, held by said force applying surface holding means at a lowest location of said plunger assembly, so that said force applying surface applies force to said first force transmitting surface when said rotary shaft positions said wedge on one side of said force transmitting surface selection area and applies force to said second force transmitting surface when said rotary shaft positions said wedge on another side of said force transmitting surface selection area.

18. An assembly as in claim 17 wherein said bore is generally the shape of a circle with an arc of the circle removed, said arc being of less than 180°.

19. An assembly as in claim 17 wherein said predetermined angle of separation of said shoulders is 60°.

20. An assembly as in claim 17 wherein said two surfaces of said force applying surface holding means are inclined with respect to the horizontal by angles which are substantially equivalent, said angles being angles such that said plunger assembly can bias against said wedge without said two surfaces contacting said wedge.

* * * * *